United States Patent [19]

Luckanuck

[11] Patent Number: 5,075,018

[45] Date of Patent: Dec. 24, 1991

[54] DRY FIRE EXTINGUISHING COMPOSITION AND PRODUCT

[75] Inventor: John S. Luckanuck, Burlington, Canada

[73] Assignee: Radixx/World Limited, Burlington, Canada

[21] Appl. No.: 443,324

[22] Filed: Nov. 30, 1989

[51] Int. Cl.[5] ..... A62D 1/00

[52] U.S. Cl. ..... 252/2; 252/3; 252/4

[58] Field of Search ..... 252/3, 4, 5, 7, 2

[56] References Cited

U.S. PATENT DOCUMENTS

| | | | |
|---|---|---|---|
| 3,055,435 | 9/1962 | Warmock | 169/31 |
| 3,214,372 | 10/1965 | Lobos | 252/2 |
| 3,947,365 | 3/1976 | Cottrell et al. | 252/5 |
| 4,042,521 | 8/1977 | Dunn | 252/5 |
| 4,406,797 | 9/1983 | Altman et al. | 252/5 |
| 4,604,318 | 8/1986 | Prior et al. | 106/85 |

OTHER PUBLICATIONS

"Alumina Trihydrate Polyfill 130", Custom Grinders Sales, Inc. Chatsworth, Ga.

"Wollastonite: Short-Fiber Filler/Reinforcement", by Joseph R. Copeland and Olinda W. Rush.

"UDET ® 950", Technical Bulletin 950, Petrochemicals Company, Inc.

*Primary Examiner*—Robert L. Stoll

*Assistant Examiner*—Joseph D. Anthony

*Attorney, Agent, or Firm*—Tilton, Fallon, Lungmus & Chestnut

[57] ABSTRACT

A fire extinguishing composition and product including Alumina Tri Hydrates as the major portion with minor portions of Wollastonite (calcium metasilicate) and an anionic surfactant all pressurized by nitrogen gas of the order of about 200 psi.

3 Claims, No Drawings

DRY FIRE EXTINGUISHING COMPOSITION AND PRODUCT

BACKGROUND AND SUMMARY OF INVENTION

This invention relates to a dry fire extinguishing composition and product and, more particularly, a product which is completely inorganic and powered by nitrogen gas.

Historically, there have been two types of fire extinguishers, wet and dry. For the most part, the dry type fire extinguishers have used as the smothering agent sodium bicarbonate. A principal problem involved with the use of sodium bicarbonate is that of settling, requiring the user to shake the valved pressure tank before use—and at a time when the user's thoughts are focused on the fire and time is critical. I have found through the use of a novel composition comprising Alumina Tri Hydrate, Wollastonite (calcium metasilicate) and a detergent such as an anionic surfactant that superior results in smothering fires is obtained, and without the disadvantage of requiring shaking inasmuch as the above composition when powered by nitrogen remains dispersed and ready for application. More especially, the inventive composition is useful in connection with all of A. B. C. fires. A. fires are classified as those involving wood, trash, and/or paper; B. fires are those involving liquids and/or greases; C. fires are those involving electrical equipment.

The composition under nitrogen pressure of the order of 190 psi (g) is advantageously contained within a valved pressure tank of which a wide variety are available. Normally, the tank is colored red and equipped at its outlet top end with a depressible handle valve and, in the larger sizes, a hose for directing the fire-smothering stream. Typical of such containers are those currently marketed by Incendex Limited of Quebec, Canada and Hampton, Virginia.

DETAILED DESCRIPTION

The invention can be best understood by consideration of a specific example of the preferred embodiment of the invention.

EXAMPLE

For optimum results I employ 90% Alumina Tri Hydrates, 8% Wollastonite, and 2% of the anionic surfactant. These are placed in a conventional fire extinguisher tank under 190 psi pressure. Such tanks normally have a top pressure rating of 250 psi and with the 190 psi the mixture was propelled 12 to 15 feet.

The Alumina Tri Hydrate is advantageously obtained from Custom Grinder Sales, Inc. of Chatsworth, Georgia under the designation Polyfil 130 and is mainly $Al_2O_3$. Alumina Tri Hydrate although dry to the touch contains three molecules of chemically combined water which is approximately 35% by weight. When the Alumina Tri Hydrate is exposed to fire with temperatures in excess of 400° F, the water vapor is released and acts as a flame retardant. The Alumina Tri Hydrates have a bulk density of about 55 to about 65 pounds per cubic foot with about ⅓ being retained on 325 mesh. The bulk therefore is of the order of about 400 mesh.

The Wollastonite is calcium metasilicate ($CaSiO_3$) and is advantageously obtained from Prescott Chemical of Toronto, Canada under the designation Nyad G. Here the particle sizes are of the order of 325 mesh and, in operation, the larger particles of Wollastonite serve to knock out the fire initially whereas the Alumina Tri Hydrates then serve to smother the fire.

The anionic surfactant is a species of detergent and excellent results are obtained utilizing a product designated Udet 950 manufactured by Petro Chemicals Company, Inc. of Fort Worth, Texas, being a linear sodium alkylaryl sulfinate normally used as a heavy duty surface detergent for floor and metal cleaners and is fully biodegradable. I find that best results are obtained when the amount of detergent is less than about 4% of the total mixture and preferably of the order of about 2%. This serves to keep the nozzle of the fire extinguisher clear as sometimes the powders will cake around the nozzle and, in the past, necessitating the inclusion of a lubricant such as a silicone.

Some variation in the amounts of the Alumina Tri Hydrates and Wollastonite may be made while still satisfactorily practicing the invention. For example, the Alumina Tri Hydrates can be reduced approximately 20%—to a level of about 70% with the deficiency then being made up by Wollastonite.

In summary, I have found advantageous the substitution for the normally employed sodium bicarbonate, a mixture of Alumina Tri Hydrates and Wollastonite with a small percentage (about 2% to about 4%) of an anionic surfactant. The Alumina Tri Hydrates range advantageously from about 70% to about 90% with the remainder (about 8% to about 25%) of Wollastonite. This is pressured by a nitrogen gas of the order of about 200 psi—as contrasted to the 150 psi normally employed in the prior art sodium bicarbonate extinguishers.

While in the foregoing specification a detailed description of an embodiment of the invention has been set down for the purpose of illustration, many variations in the details hereingiven may be made by those skilled in the art without departing from the spirit and scope of the invention.

I claim:

1. A dry fire extinguishing composition consisting essentially of from about 70% to about 90% Alumina Tri Hydrates, from about 8% to about 25% Wollastonite and from about 2% to about 4% of an anionic surfactant.

2. The composition of claim 1 in which said Alumina Tri Hydrates has a particle size of the order of about 400 mesh and the Wollastonite a particle size of about 325 mesh.

3. The composition of claim 1 in which said anionic surfactant is an alkylaryl sulfinate.

* * * * *